US007464694B2

(12) United States Patent
Chang

(10) Patent No.: US 7,464,694 B2
(45) Date of Patent: Dec. 16, 2008

(54) VARIABLE FLOW CONTROL METHOD AND DEVICE BETWEEN AIR INTAKE AND THROTTLE

(76) Inventor: Chun-Hsiung Chang, No. 5-4, Lane 201, Chung-hua Rd., Pa-Der City, Tao-yuan Hsien (TW)

( * ) Notice: Subject to any disclaimer, the term of this patent is extended or adjusted under 35 U.S.C. 154(b) by 0 days.

(21) Appl. No.: 11/473,055

(22) Filed: Jun. 23, 2006

(65) Prior Publication Data

US 2007/0295302 A1 Dec. 27, 2007

(51) Int. Cl.
*F02D 7/00* (2006.01)

(52) U.S. Cl. ..... 123/389; 123/391

(58) Field of Classification Search ..... 123/389, 123/336, 391

See application file for complete search history.

(56) References Cited

U.S. PATENT DOCUMENTS 1,413,371 A * 4/1922 Adler et al. ..... 137/512.1
3,009,475 A * 11/1961 Richterkessing et al. . 137/512.1
6,302,076 B1 * 10/2001 Bredy ..... 123/184.21
2006/0070618 A1 * 4/2006 Schimmeyer ..... 126/307 A

* cited by examiner

*Primary Examiner*—John T Kwon
(74) *Attorney, Agent, or Firm*—Bacon & Thomas, PLLC

(57) ABSTRACT

A variable flow control method and device between an air intake and a throttle comprise at least one one-way valve with suitable restoring function between the air intake and the throttle, especially for a fuel-injected car. Corresponding functions can be generated among the one-way valve, an air intake manifold and the throttle to adjust and control an engine so that the engine can rapidly get various rotating rates corresponding to various degrees of vacuum respectively as natural or original air taking can be effectively and rapidly accelerated when the accelerator is trampled rapidly, and reflect the improvement on performances responding to torsion and acceleration of the various rotating rates.

7 Claims, 2 Drawing Sheets

VARIABLE FLOW CONTROL METHOD AND DEVICE BETWEEN AIR INTAKE AND THROTTLE

BACKGROUND OF THE INVENTION

1. Field of the Invention

The present invention relates to a variable flow control method and device between an air intake and a throttle, wherein at least one one-way valve with suitable restoring function is provided between the air intake and the throttle to adjust and control an engine, so that the engine can rapidly get various rotating rates corresponding to various degrees of vacuum respectively as in natural air taking, and can control the amount of air needed for combustion in the various rotating rates. The present invention is suitable for applying to engines of vehicles and others for like purposes.

2. Description of the Prior Art

In a conventional intake system of a car, the following concept: "air flow in all the intake pipe sections and passages is asked to keep fluent, in order to reduce or remove any device or mechanism that is probable to hinder air intake" has been the most basic standard.

And in a conventional intake system of a car, there is no control device between an air intake and a throttle.

In a conventional example of a car, an air intake manifold is provided behind a throttle, all the intake pipe sections before a combustion cylinder generally are in the same length, the degrees of vacuum in the intake pipe sections are higher because of the stronger suction created by the piston of the cylinder during low rotating rates, and the degrees of vacuum in the intake pipe sections are lower during high rotating rates; a longer intake pipe is beneficial to the performance of the torsion in low rotating rates, but is disadvantageous to the performance of torsion and horsepower in high rotating rates. Moreover, the depth of the stroke in trampling an accelerator represents the degree of openness of the throttle that decides the amount of air intake, and thus the amount of gas to be sprayed out is decided. The degrees of openness of the throttle correspond to various rotating rates of an engine; certainly, various rotating rates of different gear positions correspond to various degrees of vacuum of the engine.

SUMMARY OF THE INVENTION

The variable flow control method and device between an air intake and a throttle of the present invention is provided with at least one one-way valve with suitable restoring function between the air intake and the throttle (especially for a car), so that mutual corresponding functions can be generated among the one-way valve, an air intake manifold and the throttle of the car to adjust and control an engine, such that the engine can rapidly get various rotating rates corresponding to various degrees of vacuum respectively as in natural or original air taking in a conventional way, and can effectively accelerate more rapidly when the accelerator is trampled rapidly, and reflect the improvements on performances responding to torsion and acceleration of various rotating rates.

The one-way valve of the present invention is provided with a fixing pipe whereof the inner space is formed an air intaking passage. And at least one one-way movable blade is disposed in the air intaking passage. In addition, a force restoring portion connected with the one-way movable blade is disposed thereon, such that the one-way movable blade maintained in usually-closed state in the air intaking passage, and will be opened when cylinder of engine intakes air. Furthermore a supporting portion is disposed to support and fix the one-way movable blade on the fixing pipe.

The present invention will be apparent after reading the detailed description of the preferred embodiment hereinafter in reference to the accompanying drawings.

DETAILED DESCRIPTION OF THE PREFERRED EMBODIMENT

Figure 1:
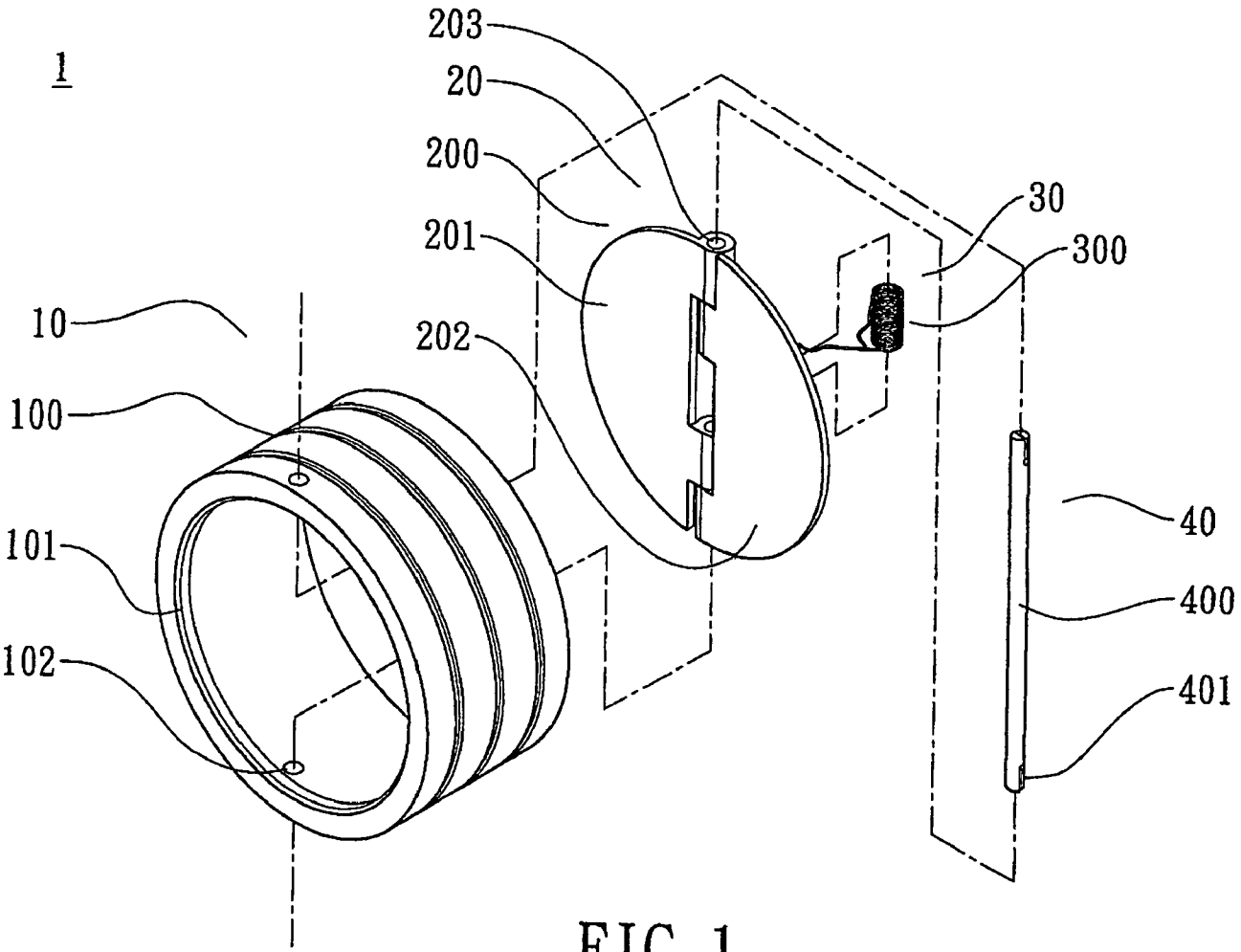
FIG. 1 is an exploded perspective view showing an embodiment of the variable flow control device between an air intake and a throttle of the present invention.
Figure 2:
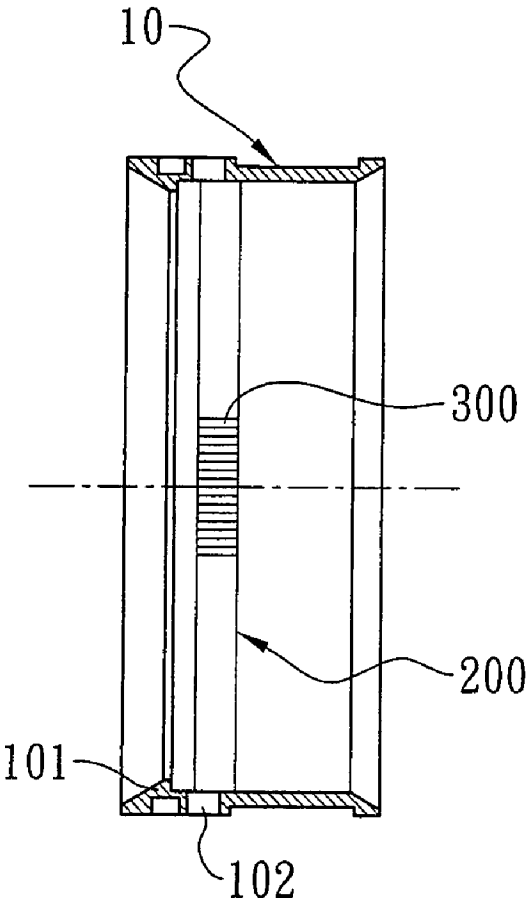
FIG. 2 is a side view, shown partially in cross section, of the embodiment of FIG. 1.

Referring to FIG. 1-2, a variable flow control device between an air intake and a throttle of an embodiment of the present invention includes at least one one-way valve 1 with suitable restoring function. The one-way valve 1 comprises a fixing portion 10, a one-way operating portion 20 having at least one one-way movable blade 201, a force restoring portion 30 and a supporting portion 40. The fixing portion 10 is consisted of a fixing pipe 100 with a reduced mouth 101 on one end. The hollow space of the fixing pipe 100 is an air-intaking passage. At least one fixing hole 102 is disposed at the fixing pipe body. The one-way operating portion 20 comprises a one-way movable blade set 200 consisted of a pair of movable blades 201, 202 pivoted and coupled with each other. At least one axis hole 203 is provided at the pivoted portion of the movable blades. The force restoring portion 30 comprises at least one spring 300 with restoring force. The supporting portion 40 comprises a fixing rod 400 with a slit 401 on the two ends respectively. The one-way movable blades are vertically disposed in the air-intaking passage of the fixing pipe 100, maintained in usually-closed state by the restoring force of spring 30, and will be pulled and opened when the engine sucks air in. The fixing rod 400 can be inserted in the axis hole 203 of one-way operating portion 20, and in the fixing hole 102 of the fixing pipe 100, thereby supporting and fixing one-way operating portion 20 on the fixing portion 10.

Instead of the spring 300, the force restoring portion 30 can be driven by a suitable motor or controlling rope or rod, and the one-way movable blades 201,202 of the one-way operating portion 20 can also keep the state in being closed at the direction that air flows in, achieving same effects in use.

After assembling, the one-way movable blades 201 and 202 of the one-way operating portion 20 as well as the spring 300 of the force restoring portion 30 can have gaps there among, which should be reduced as far as they can, i.e., air that flows through the gaps should be reduced as much as it can. By doing so, effects of various gains can be more evident and faster, and the operation of gear shifting can be more fluent.

In order to reduce the air that flows through the gaps, the one-way movable blade set 200 can be attached at its air-intaking side with a leakage-proof portion that would not hinder the opening or closing actions of the one-way movable blade set 200. For example, attached with a leakage-proof sticker that is elastically contractible and heat resistant. Surely it is also possible to be provided with other complicated mechanisms having the same function.

According to the above statements, it is easily to manufacture a variable flow control device between an air intake and a throttle of the present invention, and effects of various practical gains can be tested and proved immediately.

Furthermore, the principle of the present invention is similar to that of the common knowledge: when a suction port of a suction cleaner is partially obstructed, the degree of vacuum between the suction port and a suction pump of the suction cleaner will naturally correspondingly change. The one-way valve with suitable recovering function of the present invention keeps the state in reducing air intake at the direction that air flows in; when the engine is in any of various rotating rates corresponding to various degrees of vacuum, the engine sucks air by the vacuum sucking force of the cylinder of the engine and meantime pulls and drags the one-way valve, while a force-restoring means of the one-way valve is suitably provided, the one-way valve can be opened to exactly get the degree (or extent) of openness that can provide suitable amount of air intake required. Therefore, the action of trampling the accelerator not only opens the throttle, but also pulls the one-way valve, thus the change in degrees of vacuum of the present invention as well as the throttle and the air intake manifold can be more sensitive and apparent, and this is practically reflected in rapid starting and the evident increase of the torsion in various rotating rates as well as reflected in acceleration.

Experiments on real cars with the present invention show a fact: if degrees of vacuum change rapidly, i.e., when the accelerator is trampled rapidly, the engine is immediately forced to increase its rotating rate; when the degrees of vacuum change slowly, i.e., when the accelerator is trampled gently and slowly, the engine reacts just as the same way that can be found in any of various rotating rates originally without the device of the present invention; this means that the present invention does not hinder normal accelerating in any way.

It must be noted here that the restoring function of the one-way valve of the present invention can make adjustment so the accelerator does not need to be trampled rapidly to the end for immediately forcing the engine to increase its rotating rate, facts in many tests show that it can work and the accelerator can be immediately forced to increase its rotating rate just by trampling rapidly the accelerator in only a lighter stroke (without trampling rapidly to the end); the difference between trampling rapidly to the end and trampling rapidly for only a lighter stroke resides in the difference of rotating rates of the engine obtained after trampling the accelerator.

The present invention is arranged to be used in a 1,000 cc Korean Hyundai car six years old to do practical experiments; in D gear of the car originally without the present device but with its air conditioner turned on for one or two persons, the car is hard to react rapidly in starting and in driving even when its accelerator is trampled very heavily, and the rotating rate will stay temporarily in the same degree after very heavily trampling the accelerator, i.e., its rotating rate can only be increased after 2 or 3 times of sequentially rapid heavy trampling of the accelerator; one of the important test items for comparison is that when the air conditioner is re-turned on after a temporary pause, the car speed is evidently affected and hindered. Besides, another very important test item for comparison is that after starting the car in the condition of stopping or driving, if only rapidly trampling the accelerator for a lighter degree, it is unable to immediately force the engine to increase its rotating rate. After the application of the present invention, some improvements can be found: first, the reaction to starting becomes evidently faster even when the car is seated by four persons in D gear with the air conditioner turned on; then, only one rapid trampling of the accelerator will make its rotating rate reacted and increased immediately and its speed faster; besides, rapid re-trampling of the accelerator when the car is moving will result in the louder sound of the engine immediately and meantime the faster speed and this effect is apparently improved at any rotating rates; furthermore, when the car is moving, the speed is not evidently affected even if the air conditioner is re-turned on after a temporary pause. Certainly, if trampling the accelerator is set in rapid and lighter strokes, the engine can be easily forced to increase the rotating rate, and either when the car is moving or re-starting from stop, the speed and the rotating rate will be increased immediately. Thus, the difference of various comparison items before and after installing the device of the present invention is apparent.

Before the original car is installed with the device of the present invention, under the condition that four persons seat therein in D gear of the car with the air conditioner turned on, all reactions are identical to most cars of small horsepower, and in most cases, although the sound of the engine gets louder, the rotating rate is not increased in heavy trampling the accelerator, and there is no immediate reaction to the acceleration of the car, or even no increase of acceleration occurs. Certainly, by the fact that the present device is installed under the condition that no other equipments for air intake on the tested car are changed, the maximum speed of the car after installing with the device of the present invention does not exceed the set maximum speed of the car for the moment of production.

It is worth mentioning that the small 1,000 cc car installed with the device of the present invention can perform to the extent that the original car fails to achieve: in the beginning, the car stops on a level ground and rapidly accelerated in D gear, and then the car is started immediately and it can be found that the sound of the engine and the rotating rate are quickly up and the speed can reach 110 kilometer/hr straightly.

In an example wherein the present invention is used in a 3,000 cc Japanese Mazda MPV car four years old, the present device is installed in a single air pipe section before a throttle and after an air filter, besides, there is no other parts produced by the factory are changed; installing of the device of the present invention in this way does not at all influence the most sensitive air flow meter on the front end of the air pipe section, i.e., it does not influence the detection of a computer in the car. The effects of all tests are the same as those of the 1,000 cc car with the present invention, and all the gains are evident; it is worth mentioning that on the way up a slope of 20 to 30 degrees in D gear of the car with the air conditioner turned on, it is on purpose to lower the speed to 10 kilometer/hr and rapidly and heavily trample the accelerator; the car originally produced by the factory is unable to immediately increase the rotating rate, only the sound of the engine is louder, and the rotating rate is slowly increased and gradually accelerated; however, when the device of the present invention is installed, not only will the sound of the engine get louder, but the rotating rate is increased immediately by rapidly trampling the accelerator, and the acceleration gets faster more evidently.

Again taking the 1,000 cc car with the present invention as an example for explanation, a base of the air-intaking pipe on the front end of the air filter produced by the factory is about 26 centimeters away from a front bumper, the outer diameter of the base of the air intake pipe is 5 cm (thickness 0.3 cm), the air intake pipe is provided on its middle section with a large and a small air storing buffering chamber, they are allocated in this mode for air intake. The test car for the present invention uses an air filter and an air filtering core produced by the factory, the air intake pipe and the two air storing buffering chambers are all detached, a pipe with an inner diameter 7.7 cm (an outer diameter 8.3 cm, thickness 0.3 cm) is used instead without an air storing buffering chamber, and besides, there are no other equipments changed; such an air-intaking pipe certainly renders incomplete combustion of the 1,000 cc car and unsmooth driving. This illustrates that any part is not allowable to be substituted at will even for an air-intaking system of the small 1,000 cc car.

Then the present invention is installed in the 7.7 cm pipe nearby the air filter, by the appropriate restoring function of the one-way valve of the device of the present invention, the function of the engine is totally changed, for instance: the reaction to starting is fast and vigorous, trampling the accelerator rapidly during driving, the sound of the engine and the driving speed are quickly up; particularly for going up a 5.5 km slope of 10 to 30 degrees in D gear of the car with the air conditioner turned on for two persons, the work can be easily done with the car speed being kept at 105 km (the limitation of speed per hour is 100 km), this can not be achieved for the original car. And this illustrated that, a 7.7 cm large pipe is unable to be substituted in use, the key point is that the one-way valve of the present invention plays a function of automatically adjusting the needed amount of air taken in for the engine, and the precisely suitable amount of air intake certainly makes a car computer automatically detect and correspondingly spray precisely suitable amount of gas; in this mode, not only is the combustion of the engine again normal, but it also actually has an inclination that brings much benefit to the manufacturers. This part of explanation is the most important basis and testimony, that is, the variable flow control method and device between the air intake and the throttle of the present invention not only has no hindrance against normal trampling on the accelerator, but also is able to adjust and control the engine, in order that the engine can rapidly get any of various rotating rates corresponding to various degrees of vacuum as in natural air taking, and can effectively change to rapidly react for accelerating when in the action of rapidly trampling the accelerator, and this exactly is the method and device of the present invention that can reflect the improvements on performances responding to torsion and acceleration of various rotating rates.

When the engine is in any of various rotating rates corresponding to various degrees of vacuum, the engine sucks air by the vacuum suction of the cylinder of the engine and also pulls and drags the one-way valve; and when the force restoring means of the one-way valve is suitably provided, the one-way valve can be opened to exactly get the degree of openness that can provide the amount of air intake required; therefore, the one-way valve is pulled to reduce the afflux of excessive air, and this can reduce overly gas spraying, thereby more complete combustion of the engine can be achieved, and surely gas consumption can be reduced; through that process, the present invention can also effectively control the afflux of excessive air, namely it can reduce overly gas spraying, more complete combustion of the engine can be achieved, and surely gas consumption can be reduced; the following description is induced from the tests on a real car.

The related description of the detailed content of each test respectively on a original car produced by the factory and the same car with the device of the present invention is as following: these tests take the best gas consumption of the car in a freeway without turning on its air conditioner to compare with the data of the high speed portion in "a gas consumption test data table for a qualified imported coupe" [provided by the Bureau of Energy according to the U.S.A. FTP-75 (Federal Test Procedure) test] (the tests for this high speed portion perform with its air conditioner inactivated); the small car in the tests is a 1,000 cc Korean Hyundai car 2000 AUTOS GLS six years old, and the gas consumption test data table of the high speed portion shows the data of 19.8 km/l; the large car in the tests is a 3,000 cc Japanese Mazda 2002 MPV car four years old, and the gas consumption test data table of the high speed portion shows the data of 12.5 km/l. The best actual test field that can be found for the present invention is a circle for circulating of 75 km, in which the cars run up and down 3 ramps for 3 times; the duration of the traffic lights on the 3 ramps, the shortest is 30 seconds while the longest is 90 seconds; the situation on the road during the test, ⅓ is upgrade of about 10-15 degrees, ⅓ is downgrade of about 10-15 degrees, and ⅓ is without evident ascending and descending.

For objectively discriminating that the results of actual tests that will be affected by the records accumulated in the computer obtained from the normal use of the cars for the tests, the storage batteries are disconnected at least for one hour before each time to test the large and the small car in order to make zeroing of the computer; meantime, the speed per hour is kept at 90 km during tests. Each time in test, the mileage at least is 225 km, 300 km or 375 km. As to the matters in relation to the weight of equipments on the car, seats of the large car and the small car are not detached, the spare tires prepared by the manufacturers are not detached, the tires of the large car are of the original specifications provided by their manufacturer, and the tires of the small car are upgraded for one grade, i.e., the tires 155/70R13 provided by their manufacturer are upgraded to 165/65R13. The resulting data of each test for the large car and the small car are quite close to each other, their differences are very small and in the range of about 3-5%; the best gas consumption of the large car is 12.140 km/l that is 97.12% of what is produced by the factory, and the best gas consumption of the small car is 18.143 km/l that is 91.63% of what is produced by the factory. According to the statement "if the tires are upgraded for one grade, energy consumption will be increased" as stated in professional car magazines, the test data of the actual tests of the large and the small car are quite close to those data obtained by testing according to the U.S.A. FTP-75 test provided by their manufacturers.

According to the conventional experiences and facts, the test of the actual car's gas consumption is very hard to get close to the data provided by their manufacturers even deliberately, and normally there is quite a difference. The U.S.A. FTP-75 test on gas consumption of a car is obtained in a lab with its temperature and humidity controlled, without influence of outside weather or road conditions and without activating the air conditioner; the data is obtained by a professional driver on a dynamic meter of the car. As to the gas consumption in testing on a freeway of the present invention, the best gas consumption is 97% and (91+X) % of the high speed-gas consumption of the FTP-75 respectively; this is a real achievement obtained by the device of the present invention, and is sufficient to testify the real function of the variable flow control method and device between an air intake and a throttle of the present invention in saving gas consumption.

The variable flow control method and device between an air intake and a throttle of the present invention breaks through the most basic standard: "air flow in all the intake pipe sections and passages is asked to keep fluent, in order to reduce or remove any device or mechanism that is probable to hinder air intake" observed by conventional air intake systems; under the powerful testimony of the above stated tests of the present invention, the present invention surely is new and useful.

By summing up conventional miscellaneous principles in relation to air intake systems for cars, the present invention provides various feedbacks with high efficiency through a simple device and method; not only does it not hinder the normal trampling on an accelerator, but it also can react rapidly to generate the torsion for various rotating rates that is superior to the original cars without the device, and it can be controlled in deciding whether the engine is to be effectively accelerated, and the gear shifting actions can be smoother in automatic shifting; besides, the energy consumption can be directly reduced. The present device and method are worth being used for cars now in using, and for new designed cars as well.

Having now particularly described and ascertained the features of the present invention and function performed, we declare that what we claim is.

The invention claimed is:

1. A variable flow control method for a fuel-injected engine, which comprises the steps of:

a) selecting at least one one-way valve having a restoring function and positioning the at least one one-way valve between an air intake and a throttle of the fuel-injected engine, the restoring function returning the at least one one-way valve to a normally closed position, the throttle being adjustable between normal acceleration positions and a rapid acceleration position; and b) increasing a vacuum in an air intake manifold of the fuel-injected engine and increasing a power output of the fuel-injected engine utilizing the at least one one-way valve when the throttle is located in the rapid acceleration position, wherein, when the throttle is located in one of the normal acceleration positions, the vacuum in an air intake manifold of the fuel-injected engine and the power output of the fuel-injected engine are increased by the at least one one-way valve.

2. The method according to claim 1, wherein, in the selecting step a), the one-way valve having:

a) a fixing pipe having an air intaking passage formed on an inner space thereof;

b) at least one one-way movable blade located in the air intaking passage;

c) a force restoring portion connected to the one-way movable blade and biasing the one-way movable blade in the normally-closed position and allowing the at least one one-way movable blade to open when a cylinder of the fuel-injected engine intakes air; and d) a supporting portion supporting and fixing the one-way movable blade in the fixing pipe.

3. The method according to claim 1, wherein, in the selecting step a), the at least one one-way valve has leakage proof portion located on an air taking-in side, the leakage proof portion reducing air flowing through gaps in the at least one one-way valve.

4. A variable flow control device for a fuel-injected engine comprising:

at least one one-way valve having a restoring portion and being located between an air intake and a throttle of the fuel-injected engine, the restoring portion biasing the at least one one-way valve to a normally closed position, the throttle being adjustable between normal acceleration positions and a rapid acceleration position, the throttle and an air intake manifold controlling the fuel-injected engine, wherein, when the throttle is located in the rapid acceleration position, the at least one one-way valve increasing a vacuum in an air intake manifold of the fuel-injected engine and increasing a power output of the fuel-injected engine, and when the throttle is located in one of the normal acceleration positions, the vacuum in an air intake manifold of the fuel-injected engine and the power output of the fuel-injected engine are increased by the at least one one-way valve.

5. The variable flow control device according to claim 4, wherein the at least one one-way valve includes an assembly having:

a) a fixing pipe having a reduced mouth on one end thereof;

b) a one-way operating portion having at least one one-way movable blade; and c) a supporting portion including a fixing rod for supporting the at least one one-way movable blade and having at least one spring.

6. The variable flow control device according to claim 4, wherein the at least one one-way valve has leakage proof portion located on an air taking-in side, the leakage proof portion reducing air flowing through gaps in the at least one one-way valve.

7. The variable flow control device according to claim 5, wherein the fixing pipe has an air intaking passage formed in an inner space thereof and at least one fixing hole located thereon, the one-way operating portion has a pair of one-way movable blades pivotally coupled together at an axle holes formed therein, the pair of one-way movable blades are vertically positioned in the air intaking passage; and the fixing rod is inserted in the axis holes and the at least one fixing hole, the fixing rod fixing the one-way operation portion to the fixing pipe.

* * * * *